United States Patent [19]

Ekwall

[11] 4,333,538

[45] Jun. 8, 1982

[54] PNEUMATIC DRILL LUBRICATOR

[75] Inventor: Carl G. B. Ekwall, Saltsjöbaden, Sweden

[73] Assignee: Atlas Copco Aktiebolag, Nacka, Sweden

[21] Appl. No.: 80,673

[22] Filed: Oct. 1, 1979

[30] Foreign Application Priority Data

Oct. 6, 1978 [SE] Sweden ..... 7810468

[51] Int. Cl.[3] ..... B25D 17/26

[52] U.S. Cl. ..... 173/104; 173/DIG. 3; 91/46; 92/154

[58] Field of Search ..... 173/DIG. 3, 104; 91/46; 92/153, 154; 55/396, DIG. 17

[56] References Cited

U.S. PATENT DOCUMENTS

| | | | |
|---|---|---|---|
| 1,081,351 | 12/1913 | Waugh . | |
| 1,463,990 | 8/1923 | Wilson | 55/DIG. 17 |
| 2,698,604 | 1/1955 | Edwards | 91/46 |
| 3,252,270 | 5/1966 | Pall et al. | 55/DIG. 17 |
| 3,534,553 | 10/1970 | Norton et al. | 91/46 |
| 3,837,432 | 9/1974 | McKendrick | 92/154 |
| 3,921,731 | 11/1975 | Ekwall et al. | 173/DIG. 3 |
| 3,983,788 | 10/1976 | Andersson et al. | 91/46 |

FOREIGN PATENT DOCUMENTS

| | | |
|---|---|---|
| P 4754 | 7/1951 | Fed. Rep. of Germany . |
| 2261844 | 9/1978 | France . |

*Primary Examiner*—Werner H. Schroeder
*Assistant Examiner*—Andrew M. Falik
*Attorney, Agent, or Firm*—Frishauf, Holtz, Goodman & Woodward

[57] ABSTRACT

Oil is supplied to the compressed air supply hose for a jack leg drill by means of a conventional in-line oiler. A substantial part of the oil is separated from the drive air by means of a wall flow separator at the drill and conveyed through internal passages in the drill to various parts to be lubricated such as a chuck and a ratchet mechanism for rotating the chuck.

14 Claims, 4 Drawing Figures

PNEUMATIC DRILL LUBRICATOR

BACKGROUND OF THE INVENTION

This invention relates to a method of lubricating a rock drill and it also relates to a rock drilling apparatus.

Conventionally, for lubricating a rock drill that has a compressed air operated impact motor, oil is supplied to the compressed air supply conduit at a distance from the rock drill and transported to the rock drill by the air. In this way, the sliding surfaces between the hammer piston and the cylinder of the impact motor are lubricated. Usually a small part of the supplied air leaks forwardly in the rock drill and lubricates the piston stem and a rotation chuck. If the rock drill has a piston stem actuated ratchet mechanism for rotating the chuck, the leaking oil is also used to lubricate this mechanism. With this method, more oil must normally be added to the drive air than would be necessary for lubricating the piston and cylinder in order to ensure proper lubrication of the other parts to be lubricated.

Another method is described in U.S. Pat. No. 3,983,788. In the impact motor illustrated therein, the hammer piston is not guided against the cylinder but its two piston rods are guided in guide bushings whereas there is a clearance between the hammer piston and the cylinder. Therefore, no oil need to be added to the drive air for the impact motor, but there is a secondary compressed air supply hose for oil-loaded compressed air that is conveyed through passages in the housing to the guide bushings for the hammer piston.

It is an object of the invention to make it possible to adapt the lubrication to the various needs of the parts to be lubricated without making the rock drill or the lubricator complicated and without using additional hoses.

SUMMARY OF THE INVENTION

In the method according to the invention for lubricating a rock drill that has a compressed air operated impact motor, oil is supplied to the compressed air supply conduit at a distance from the rock drill and transported to the rock drill by the air. A substantial part of the oil is then separated from the drive air of the impact motor before the impact motor and the separated oil is conveyed to parts to be lubricated in the rock drill.

The invention can be applied both to rock drills which need lubrication on the surfaces between the piston and cylinder and to rock drills that do not need such lubrication provided that the oil supply to the compressed air supply passage and the oil separation rate are adapted to the needs of the particular machine.

DETAILED DESCRIPTION

Figure 1:
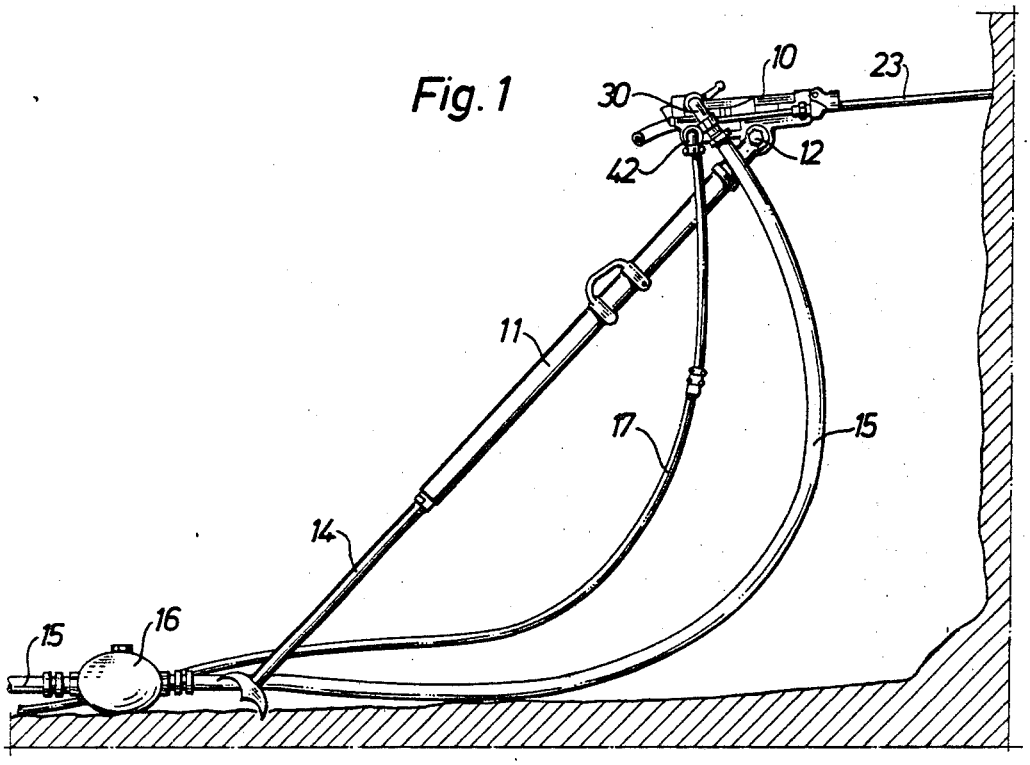
FIG. 1 shows a rock drill that has a jack leg.

The rock drill 10 has a leg 11 mounted to it by means of a pivot joint 12. The leg comprises a double acting compressed air jack that has a piston with a piston rod 14 that is adapted to take support against the floor. Such a jack leg drill is used for example in tunnel driving. The drill 10 is supplied with compressed air from a compressed air line through a hose 15. The hose 15 is provided with an in-line oiler 16, e.g. an oiler of the Venturi-type, that supplies oil to the hose 15 when there is an air flow in the hose. Flushing water is supplied through another hose 17. The jack leg is supplied with air through a non-illustrated control valve on the drill and through non-illustrated passages in the joint 12.

Figure 2:
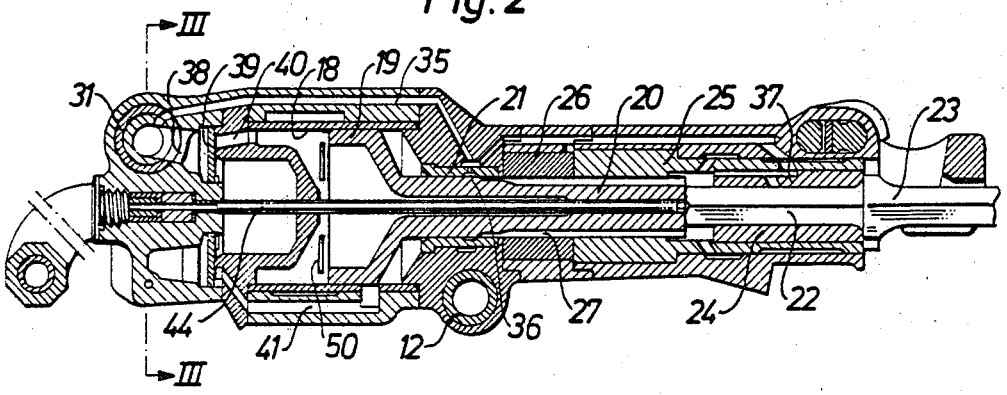
FIG. 2 is a longitudinal section through the rock drill shown in FIG. 1.

As seen in FIG. 2, the drill 10 has a cylinder 18 in which a hammer piston 19 is reciprocable. The piston 19 has a stem or piston rod 20 that extends through a guide bushing 21. The piston 19 hits the end face of the shank 22 of a drill steel 23 with the end face of its stem 20. The shank 22 has a hexagonal cross-section and it is inserted into a chuck bushing 24 with a corresponding hexagonal hole. The chuck bushing 24 is mounted in a rotatably journalled chuck 25 to rotate conjointly therewith. The chuck 25 and thereby the drill steel 23 is rotated during the return stroke of the piston 19 by means of a ratchet wheel mechanism principally of the kind shown in U.S. Pat. No. 1,081,351. The ratchet wheel 26 is rotatably journalled but because of its engagement with non-illustrated pawls mounted in the housing of the drill, it can rotate in one direction only. It also engages with two inclined grooves on the piston stem 20. These inclined grooves cannot be seen in FIG. 2. The piston stem 20 has also two straight grooves 27 that engage the chuck 25.

Figure 3:
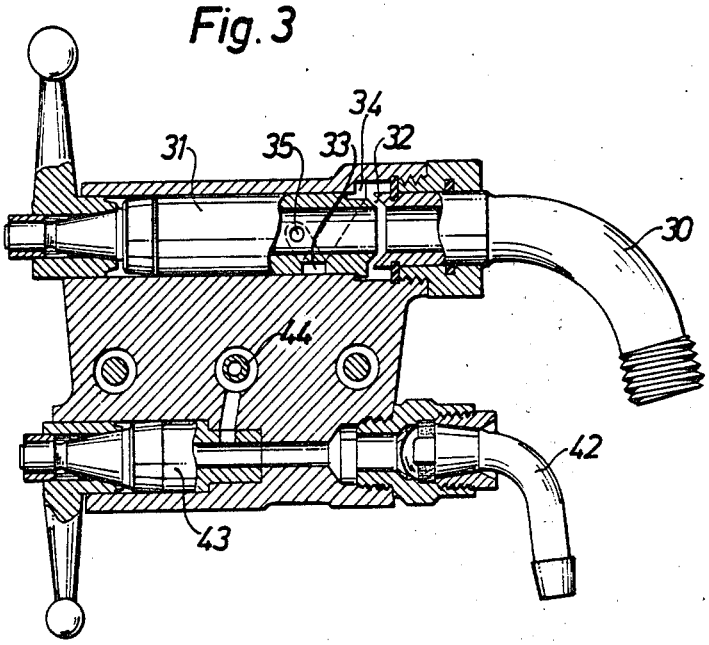
FIG. 3 is a transverse section taken along line 3—3 in FIG. 2.

The drill 10 has a fitting 30 for the air hose 15 (FIG. 3). A manually operated supply valve in the form of a cock 31 is located in a bore that is coaxial with the fitting 30. The fitting 30 and the cock 31 form together a wall flow separator that has an annular slot 32. A helical groove 33 in the wall of the cock leads from an annular chamber 34 outside of the slot to the mouth of a lubricant passage 35. When the cock is in its closed position, the groove 33 is shut off from the lubricant passage 35. Alternatively, the groove 33 can be formed so that it is always open to the lubricant passage 35. The passage 35 leads to the guide bushing 21 which has radial holes 36 therein in order to permit oil to pass to the piston stem 20. The lubricant passage 35 also leads to the non-illustrated ratchets and to the chuck 25. There are holes 37 through the chuck 25 and through the chuck bushing 24 in order to convey oil to the surface between the chuck 25 and chuck bushing 24 and to the shank 22 of the drill steel 23.

From the valve 31, the drive air is conveyed through a passage 38 to a valve 39 that controls passages 40, 41 in order to alternatively supply drive air to the two sides of the piston so as to reciprocate the piston. Flush water is conveyed from the fitting 42 for the hose 17 to a manually operated valve 43 (FIG. 3) in the form of a cock and from there to a flushing valve tube 44 that extends into the shank 22 of the drill steel. The cylinder 18 has exhaust ports 50.

Almost all the oil that is supplied to the drive air by the oiler 16 will be in the form of a wall flow when it reaches the fitting 30. This oil flows into the slot 32 (FIG. 3) so that is becomes separated from the drive air and it is transported together with compressed air through the lubricant passage 35 to the parts to be lubricated. It is advantageous that air and not only oil is transported through the lubricant passage 35 since the air keeps the internal front portion of the drill clean.

The piston 19 is usually sliding against the cylinder 18. However, the tolerances can be chosen so that the piston will be guided only on its stem 20 and so that there will be no direct contact between the piston 19 and the cylinder 18 as described in U.S. Pat. No. 3,983,788. The efficiency of the separator should then be adapted to the various need of lubrication, and the oiler should also be adjusted to suit the respective drill. When there is no contact between the piston and cylinder, the oiler should add less oil and the separator should separate more oil than when there is direct contact. The separator should separate more than ¾ of the oil that is added. When there is direct contact, the separator could for example take away about half the added amount of oil, sometimes even more, in order to make a proper distribution of oil.

If the drill has a separate compressed air driven rotation motor instead of a rotation mechanism driving by the hammer piston, one wall flow separator can be used for separating drive air with oil to the rotation motor and another wall flow separator can be used to separate oil to the parts to be separately lubricated such as the chuck as described above.

Figure 4:
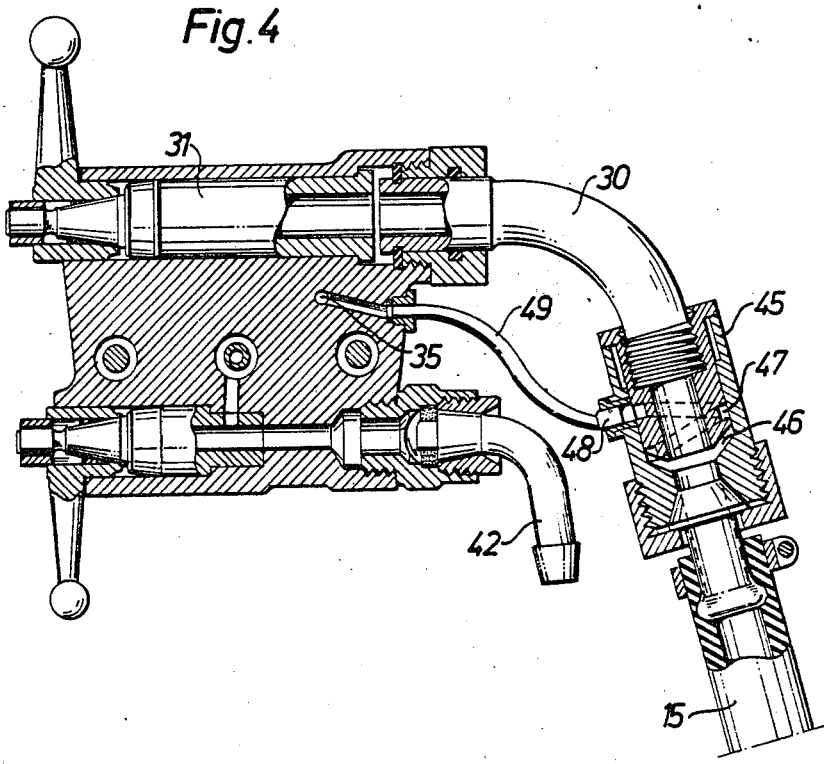
FIG. 4 is a transverse section corresponding to FIG. 3 but showing a modified design.

In FIG. 4, an alternative design is shown in which the wall flow separator is a separate unit 45 screwed to the fitting 30. The separator 45 has a slot 46 and a groove 47 that leads to an outlet 48 for oil. A hose 49 leads from this outlet 48 to the lubrication passage 35.

I claim:

1. Rock drilling apparatus comprising:

a rock drill having a pneumatic impact motor (10), a supply conduit (15) coupled to the rock drill for supplying compressed drive air to the impact motor, and an oiler (16) coupled to the supply conduit (15) at a distance from the rock drill to supply oil to the air in said air supply conduit (15), the improvement comprising:

a wall flow oil separator (30–33; 45) arranged in connection with the rock drill (10) to separate oil from the oil containing drive air in the drive air supply conduit (15) before the oil containing drive air reaches the impact motor, and at least one conveying passage (35) in said rock drill and coupled to said oil separator for conveying the separated oil to parts (21, 24, 25) to be lubricated within the rock drill, said wall flow oil separator including a passage for receiving the oil containing drive air and a transverse slot (32, 46) in a wall of said passage of the oil separator, said transverse slot being coupled to said at least one conveying passage (35) to supply the separated oil to said at least one conveying passage.

2. Rock drilling apparatus according to claim 1 wherein the rock drill (10) comprises a rotation mechanism (20, 24, 25, 26, 27) arranged for rotating a drill steel (23), and the impact motor (10) includes a hammer piston (19) for driving the rotation mechanism, and said conveying passage (35) is arranged for conveying at least a part of the separated oil to the rotation mechanism.

3. Rock drilling apparatus according to claim 1 wherein the rock drill includes a rotatably journalled chuck; and said conveying passage (35) conveys at least a part of the separated oil to the rotatably journalled chuck.

4. Rock drilling apparatus according to claim 1 wherein the rock drill includes a rotatably journalled chuck; and said conveying passage (35) conveys at least a part of the separated oil to the rotatably journalled chuck.

5. Rock drilling apparatus according to claim 1 wherein said oil separator is located at the connection of said supply conduit to the rock drill.

6. Rock drilling apparatus according to claim 5 wherein said oil separator is located inside a housing of the rock drill.

7. Rock drilling apparatus according to claim 1 wherein said oil separator is located inside a housing of the rock drill.

8. Rock drilling apparatus according to claim 1 wherein said oil separator is coupled in said supply conduit adjacent the rock drill, and further including an oil conduit (49) coupling said oil separator to said passage (35).

9. Rock drilling apparatus according to claim 1 wherein the receiving passage of said wall flow separator comprises an elongated conduit, and said transverse slot comprises an annular slot (32) arranged in said elongated conduit and effectively separating said elongated conduit into two adjacent conduit members, the oil passing out of said elongated conduit through said annular slot (32); and further including means (33) coupling said annular slot with said conveying passage (35).

10. Rock drilling apparatus according to claim 9 wherein said oil separator further comprises a valve for controlling and selectively closing said annular slot.

11. Rock drilling apparatus according to claim 10 wherein said valve includes at least one of said two adjacent conduit members.

12. Rock drilling apparatus according to claim 1 wherein said transverse slot is a slot (32) between two separate elements (30,31) of said oil separator, one of said separate elements comprising a cock (31) of a supply valve for the oil containing drive air supplied to the oil separator.

13. Rock drilling apparatus according to claim 1 or 12, wherein the impact motor (10) comprises a reciprocating impact piston (19) having a head reciprocable in a cylinder (18) and a piston stem (20), and a guide bushing (21) for guiding the piston stem such that there will be no direct contact between the piston head and the cylinder, said oil separator (30–33; 45) being arranged to separate more than ¾ of the oil supplied by the oiler (16) to said drive air.

14. Rock drilling apparatus according to claim 1, wherein said oil separator is arranged to separate at least about half of the oil supplied by the oiler (16) to said drive air in said supply conduit (15).

* * * * *